United States Patent [19]

Kurtz

[11] Patent Number: 4,821,044

[45] Date of Patent: Apr. 11, 1989

[54] WAVEGUIDE SLOT ARRAY TERMINATION AND ANTENNA SYSTEM

[75] Inventor: Louis A. Kurtz, Woodland Hills, Calif.

[73] Assignee: Hughes Aircraft Company, Los Angeles, Calif.

[21] Appl. No.: 38,083

[22] Filed: Apr. 14, 1987

[51] Int. Cl.[4] ..... H01Q 13/10

[52] U.S. Cl. ..... 343/771

[58] Field of Search ..... 343/771, 746, 762, 770; 333/21 R, 239, 248

[56] References Cited

U.S. PATENT DOCUMENTS

| | | | |
|---|---|---|---|
| 3,004,259 | 10/1961 | Shanks et al. | 343/746 |
| 4,429,313 | 1/1984 | Muhs, Jr. et al. | 343/771 |

FOREIGN PATENT DOCUMENTS

| | | | |
|---|---|---|---|
| 0159301 | 10/1985 | European Pat. Off. | 343/770 |
| 2494047 | 5/1982 | France | 343/700 MS |
| 88/02934 | 4/1988 | PCT Int'l Appl. . | |

*Primary Examiner*—William L. Sikes

*Assistant Examiner*—Doris J. Johnson

*Attorney, Agent, or Firm*—M. W. Sales; V. G. Laslo; A. W. Karambelas

[57] ABSTRACT

A termination (20, 32) is placed in the opposing wall behind the center radiator (18c, 28c) of a multiple slot antenna array. The termination is inoperative when the array is excited for sum mode radiation patterns and is operative when the array is excited with difference mode radiation patterns. When the termination is inoperative, the center slot radiator is excited along with the remaining slot radiators (18, 28) to produce the sum pattern. When the termination is operative, the center slot radiator is prevented from receiving excitation and a resultant difference pattern is produced by the remaining slot radiators (18, 28). Both E-plane and H-plane patterns can be achieved by the appropriate use of series slots and shunt slots. By eliminating the center slot (18c, 28c) in the difference pattern a reduction in side lobes results. This is an improvment over current practice where there are an even number of slots and no change of amplitude distribution—only a change of 180° phase between the halves for the difference mode.

16 Claims, 3 Drawing Sheets

WAVEGUIDE SLOT ARRAY TERMINATION AND ANTENNA SYSTEM

BACKGROUND AND SUMMARY OF THE INVENTION

1. Field of the invention

The present invention relates generally to microwave slot array antennas. More particularly the invention relates to a waveguide slot array system employing a termination at the center of the array which is inoperative when the array is excited in a sum mode and which is operative when the array is excited in a difference mode, thereby achieving a different array excitation than is customary when only the phase is changed for each mode.

2. Description of Related Art

Waveguide-fed slot radiators and slot array antennas are widely used in microwave communications and radar applications. In these applications, it is frequently important to design the antenna to have minimal side lobe patterns in both the horizontal and vertical planes, as this will help reduce the communications or radar system's susceptibility to jamming and interference. Many of today's microwave systems utilize both sum (in-phase) and difference (out-of-phase) excitation of the antenna aperture. In a monopulse tracking radar, for example, the sum and difference excitations provide different signals which can be compared and analyzed with respect to amplitude and phase in order to determine the spatial position of a target. In such radar systems, it is desirable that the antenna have minimal side lobes in both planes for both modes of excitation. This has been difficult to achieve in practice, since the excitation which lowers the sum mode side lobe pattern increases the difference mode side lobe pattern in conventional array antennas.

Traditionally, the approach to slot array antenna design has been to design the antenna for optimum side lobe pattern for sum mode excitation and then be willing to accept whatever difference mode side lobe pattern results. Traditionally, there has been no effective way of providing independent control over the side lobe patterns for the sum and difference modes separately.

One approach to this design problem which has been considered is that described in my U.S. Pat. No. 2,981,948 which issued on Apr. 25, 1961, entitled "Simultaneous Lobing Array Antenna System," assigned to the assignee of the present invention. That antenna system employs a directional coupler or hybrid junction to achieve a unidirectional subdivision of the antenna array. Although useful in providing simultaneous lobing, that antenna is not practical in a waveguide-fed slot array for use in certain applications such as missile seeker applications and flat-plate seeker antennas. Strip line-fed slots and dipoles have also been used to achieve independent aperture distributions for sum and difference excitation, but these have the disadvantages of complex fabrication and higher loss, to name but two.

SUMMARY OF THE INVENTION

The present invention uses auxiliary slots and waveguide stubs or lines to create a termination at the center of a linear array of slot radiators. To maintain symmetry, an odd number of slot radiators are used, with the termination positioned behind the center slot. The termination is inoperative when both ends of the array are fed in phase to radiate a sum pattern. When fed out of phase to radiate a difference pattern, the termination operates to provide isolation between halves of the array and to eliminate excitation of the center slot, thus lowering the side lobe level of the difference pattern. Using the techniques of the invention, it is now possible to lower the difference pattern side lobes without substantially altering the sum pattern side lobes for both shunt slot and series slot arrangements.

While the principles of the invention are applicable individually to shunt slot and series slot arrangements, both arrangements can be combined to produce an advantageous flat-plate seeker antenna which uses shunt slots as the radiating elements and which uses series slots in the waveguide feed arrangement. The invention is particularly suited to comparatively small array antennas, e.g. 5 to 13 element, one-dimensional arrays and 5 to 13 element by 5 to 13 element, two-dimensional arrays.

In summary, the invention comprises a slot array antenna having different amplitude distribution for sum and difference radiation patterns. The invention comprises a waveguide section having at least one pair of opposing broadwalls and having first and second ends for exciting with electromagnetic energy. The waveguide has an odd number of slot radiators, including a center slot radiator at spaced intervals in one of the broadwalls. At least one termination means is disposed behind the center slot radiator in the opposing broadwall, opposite the broadwall in which the slot radiators are disposed. The termination is oriented so that in-phase excitation of the two halves of the array produces a substantially inoperative termination, thereby permitting the excitation of the center slot radiator. The termination is oriented so that out-of-phase excitation of the two halves of the array produces an operative termination, thereby substantially preventing the excitation of the center slot radiator. In this fashion, the amplitude distribution is altered for difference pattern excitation without altering the sum pattern excitation. Consequently, lower difference pattern side lobes are achieved than when this termination is not used. For a more complete understanding of the invention, its objects and advantages, reference may be had to the following specification and to the accompanying drawings.

DESCRIPTION OF THE PREFERRED EMBODIMENT

Figure 1:
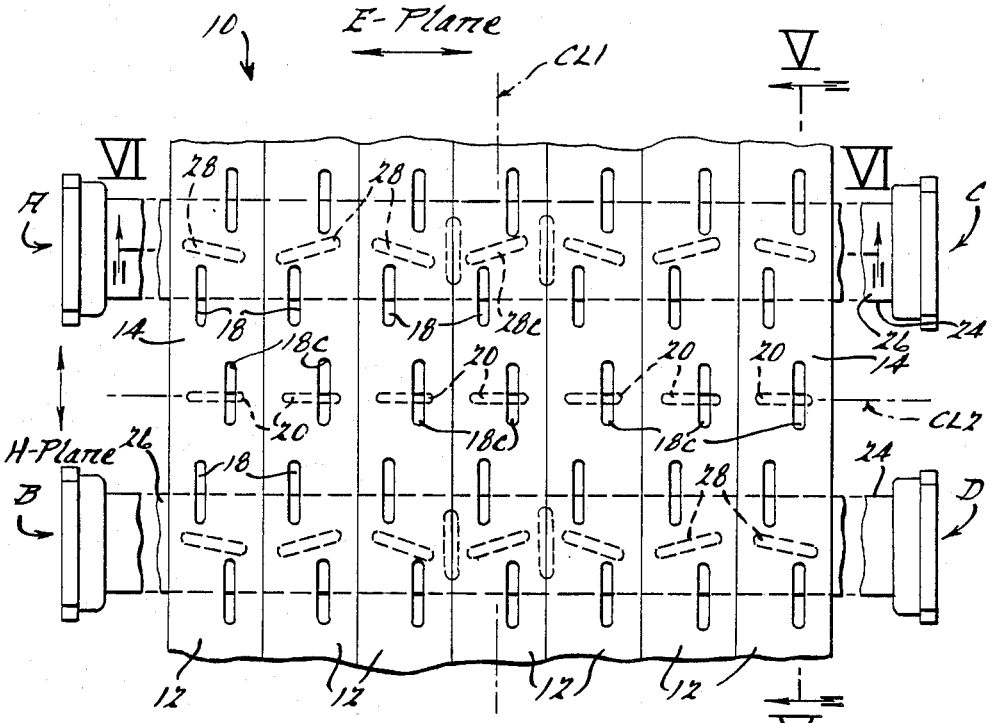
FIG. 1 is a front view of a two dimensional slot array antenna employing the principles of the invention.
Figure 4:
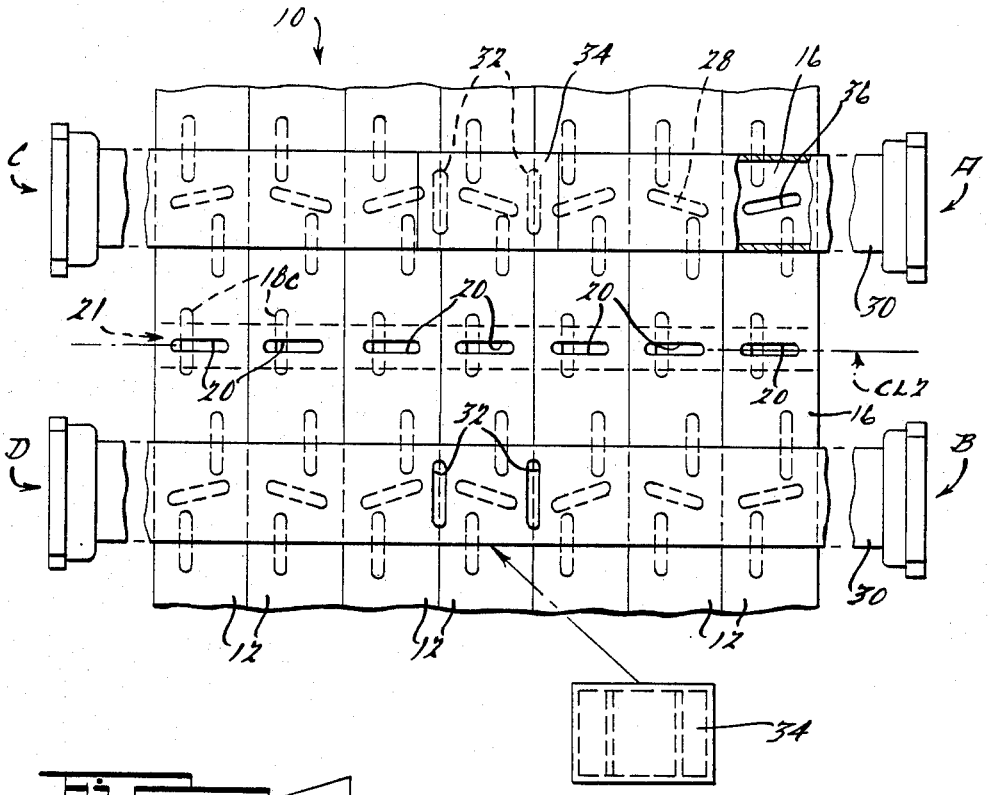
FIG. 4 is a rear view of the seeker antenna of FIG. 1, illustrating one of the auxiliary wave path bypass sections removed.

In order to describe the principles of the invention, a flat-plate antenna array will be considered. However, it will be understood that the principles of the invention are applicable to other types of slot array antennas as well, and thus the illustration of a flat-plate antenna array is not to be considered as a limitation of the scope of this invention. A flat-plate antenna array 10 is illustrated in FIGS. 1 and 4, FIG. 1 depicting the front side of the antenna and FIG. 4 depicting the rear side Array 10 comprises a plurality of waveguide sections 12 which are disposed parallel to and contacting one another. Preferably, waveguide sections 12 are arranged with the broadwalls or longer sidewalls 14 in a common plane, with the opposing sidewalls 16 (FIG. 4) similarly in a common plane. Sidewalls 14 are provided with a plurality of shunt slots or shunt slot radiators 18 positioned as shown in FIG. 1.

Figure 3A:
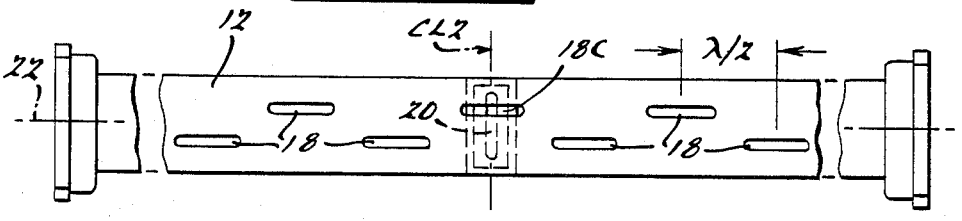
FIGS. 3*a* and 3*b* illustrate a waveguide section having shunt slot radiators in one of the waveguide walls and having a termination in the opposing wall in accordance with the invention.
Figure 3B:
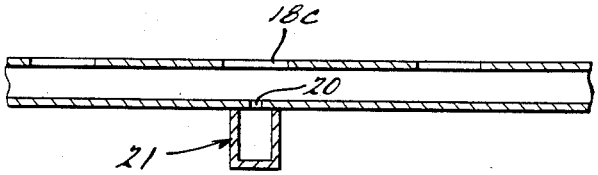

FIG. 3 depicts a single waveguide section which is similar in construction to each of waveguide sections 12. Waveguide sections 12 are provided with an odd number of shunt slots, so that the waveguide sections exhibit bilateral symmetry about a center line CL2. Positioned in the back sidewall 16 opposite the center shunt slot 18C is a termination slot 20. Termination slot 20 is oriented as a series slot at right angles to the shunt slot 18C and is positioned along center line CL2. Slot 20 couples into a short circuited waveguide stub 21 one quarter guide wavelength long. Shunt slots 18 are located alternately on each side of the longitudinal center line 22 of the waveguide section 12 and separated from one another by approximately one-half of the waveguide wavelength of array 10.

Figure 2:
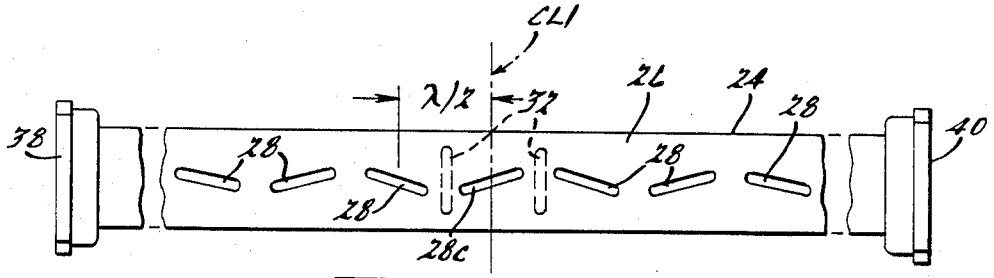
FIG. 2 illustrates a waveguide section having series slots in one of the waveguide walls and having a termination in the opposing wall in accordance with the invention.
Figure 5:
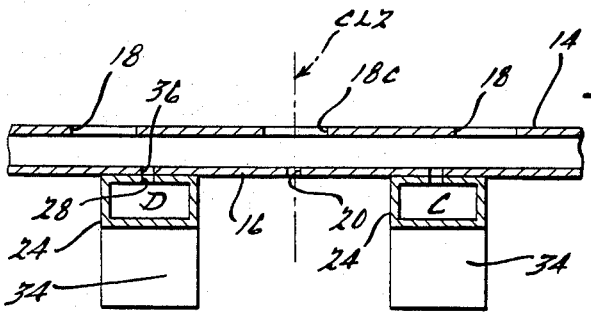
FIG. 5 is a cross-sectional view taken substantially along the line V—V of FIG. 1.
Figure 6:
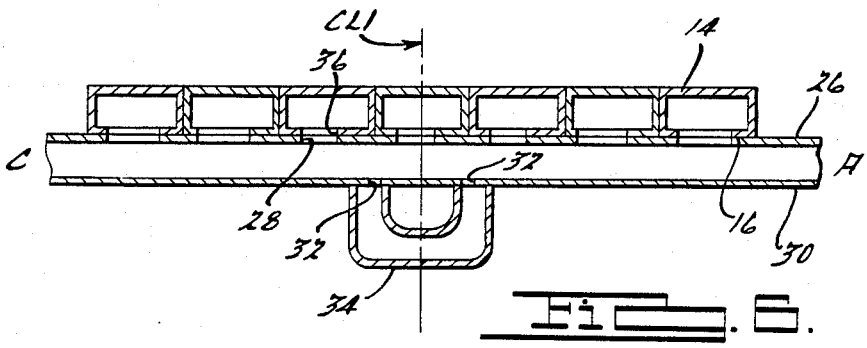
FIG. 6 is a cross-sectional view taken substantially along the line VI—VI of FIG. 1.

Array 10 further comprises a pair of feed waveguides 24 which are spaced apart and parallel to one another and perpendicular to waveguide sections 12. Feed waveguides 24 have a first broadwall 26 which contacts the opposing broadwall 16 of the waveguide sections 12. FIG. 2 illustrates a waveguide of similar configuration to feed waveguides 24. Feed waveguides 24 and the waveguide of FIG. 2 are provided with series slots 28 in the first broadwall 26 thereof. As illustrated, series slots 28 may be alternately angled and spaced approximately one-half waveguide wavelength apart. Preferably, there are an odd number of series slots, including a center slot **28*c*. Center slot 28*c* lies on the centerline CL1. Positioned in the opposite broadwall 30 (FIG. 4) are a pair of termination slots 32. Termination slots 32 are equidistant a quarter waveguide wavelength from center slot 28*c* and communicate with auxiliary wave path 34 which may be a generally U-shaped bypass waveguide. Preferably, the path length of auxiliary wave path 34 is one wavelength, or a multiple thereof. Auxiliary wave path 34 is also seen in FIGS. 5 and 6**.

Feed waveguides 24 communicate with waveguide sections 12. Waveguide sections 12 are provided with series slots 36 (see FIG. 4) in the opposing broadwall 16 which register with the series slots 28 of the feed waveguides. The resulting antenna array 10 is a four-port device with the ends A, B, C and D of the feed waveguides serving as the ports. By feeding all four ports in phase, sum channel excitation is achieved. When ports A and B are fed 180° out of phase with respect to ports C and D, E-plane difference excitation is achieved. When ports A and C are fed 180° out of phase with respect to ports B and D, H-plane difference excitation is achieved. Through the principles of reciprocity, the same analysis results when the antenna array is used to receive a signal such as a return from a target in a monopulse radar system. Thus by properly comparing the amplitude and phase of the received energy at ports A, B, C and D, the spatial location of the target can be determined.

In order to understand the principles of the invention in operation, the E-plane and H-plane distribution patterns will be treated separately in terms of the linear arrays which generate each aperture distribution The E-plane and H-plane are designated by double-ended arrows in FIG. 1. In the H-plane, the shunt slots 18 of waveguide sections 12 control the pattern, whereas in the E-plane, the series feed slots 28 control the pattern. To better understand how these patterns differ for sum and difference excitations, reference will be made to FIGS. 2 and 3. FIGS. 2 and 3 depict single waveguides implementing generally one-dimensional slot antenna arrays. Reference to these one-dimensional arrays will somewhat simplify the analysis of the invention in operation It will be understood, however, that the principles described also operate in the more complex two-dimensional flat-plate antenna array 10 of FIG. 1, and the reader will recognize that flat-plate antenna array 10 is comprised of waveguides and waveguide sections constructed similar to the waveguides of FIGS. 2 and 3.

Turning first to the analysis and the series-fed array of FIG. 2, it is seen that the waveguide has an odd number of series slots 28, including a center series slot **28*c*. The waveguide has ends 38 and 40 for exciting with electromagnetic energy. When energy is fed in phase into ends 38 and 40, a difference excitation results. When energy is fed out of phase into ends 38 and 40, a sum excitation results. Although not visible in FIG. 2, it will be understood that the waveguide includes a pair of termination slots 32 which communicate with an auxiliary wave path (such as wave path 34 of FIG. 4**).

In the case of sum excitation, each of the series slots 28, including center slot **28*c*, is properly excited. Since the energy fed at both ends is 180° out of phase, the termination slots 32** are excited oppositely by the energy from the left and right plus the energy that traverses the auxiliary wave paths, so that the net voltage of the termination slots approaches zero. In this instance, the termination slots are effectively decoupled from the rest of the waveguide.

When the ends 38 and 40 are excited in phase (difference excitation), the voltage at termination slots 32 doubles, thus presenting open circuits to the portions of the waveguide on each side of center line CL1. Thus the series slots 28 remain properly terminated with the net voltage in the center slot **28*c*** approaching zero. Because the center slot is near zero voltage, it is virtually decoupled from the rest of the waveguide and little or no energy radiates from that slot. By virtue of this fact, the resulting amplitude distribution of slot voltages differs from that which results when sum excitation is employed. This difference in amplitude distribution will be most apparent in the resulting difference radiation pattern when the number of slots on either side of the center slot is relatively few (e.g. two to six elements on each side of the center). In this instance, the center element is not a negligible element of the whole array and the presence or absence of the center element has a quite noticeable effect on the resulting difference radiation pattern.

Figure 9:
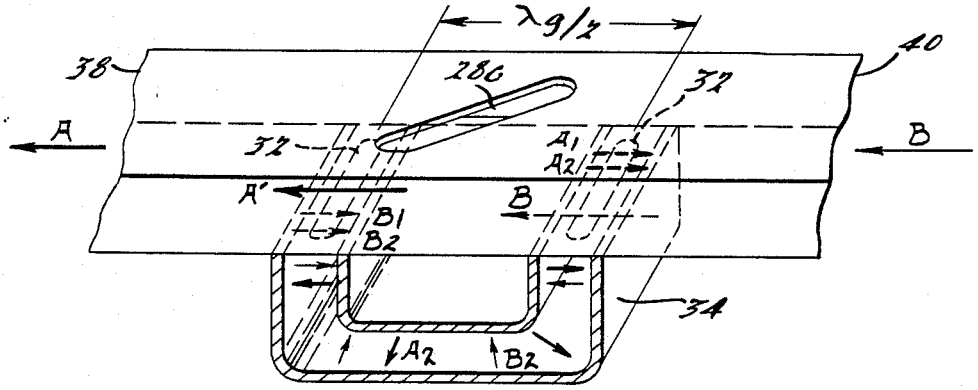
FIG. 9 is a perspective view of the series slot embodiment of the invention.

For a more complete understanding of this phenomenon reference may now be had to FIG. 9 which depicts the center series coupling slot 28*c* and the two termination slots 32 to the left and right of slot 28*c*. For sum mode excitation slots 32 have very small net excitation, $VA+VB_1+VB_2$ and $VB+VA_1+VA_2$, where $VB_1$ is the voltage in the left-hand slot due to the wave from port 40 which travels past the first or right-hand termination slot to the second or left-hand one, a distance of one-half the waveguide wavelength (180° phase shift). $VB_2$ is the voltage in the left-hand slot due to the wave from port 40 that travels through the auxiliary branch line 34, a path which is one waveguide wavelength long. A phase reversal occurs because of the 180° bend in the auxiliary branch line. VA is the voltage excitation of the left-hand slot by the wave from port 38. (Recall that port 38 is fed out of phase with the wave at 40.) The sum of $VA+VB_1+VB_2$ approaches zero so that effectively the left-hand termination slot 32 does not block wave A from reaching and exciting the center slot 28*c*. The net voltage excitation of the right-hand terminating slot is $VB+VA_1+VA_2$ (where corresponding similar notation is used). This net voltage is likewise small and does not effectively prevent excitation of slot 28*c* by wave B from port 40.

During difference mode excitation of ports 38 and 40, the partial slot voltages A, $B_1$ and $B_2$ are in phase. This nearly doubles the left-hand termination slot voltage. The slot appears as an open circuit termination for the wave from port 38. Likewise the same is true for B, $A_1$ and $A_2$ and the wave from port 40. The center slot 28*c* is thus isolated and not excited during difference mode excitation of ports 38 and 40.

Turning now to the analysis of the shunt slot radiators of FIG. 3, it is seen that the waveguide is provided with an odd number of shunt slots 18, including one center slot 18*c* disposed on center line CL2. For sum channel excitation, all slots 18 are in phase and the center slot 18*c* is excited. The termination slot 20 lies in the plane of a virtual open circuit, i.e., maximum E field across the waveguide and zero longitudinal current in the broadwalls. Thus, the termination slot voltage is zero. Hence, the termination slot receives little or no energy and is thus inoperative insofar as the center shunt slot 18*c* is concerned. When difference channel excitation is employed, the termination slot 20 lies in the plane of a short circuit, is fully excited, and couples energy into waveguide stub 21. Waveguide stub 21 presents an open circuit to slot 20 which in turn is then coupled into waveguide 12 forming an open circuit termination to the two halves of the array on either side of the center line CL2, thereby isolating the two halves. The voltage in center slot 18*c* is reduced to zero in this instance because of out of phase excitation from ports at opposite ends of the waveguide 12. This effectively removes slot 18*c* as a contributor to the overall difference radiation pattern. Hence, as in the case of the E-plane analysis, the center slot 18*c* can be effectively coupled or decoupled from the overall array by rendering the termination inactive or active through selection of the correct excitation mode.

Figure 7:
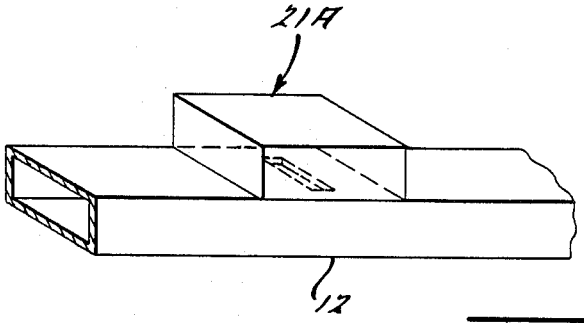
FIGS. 7 and 8 show alternative embodiments.
Figure 8:
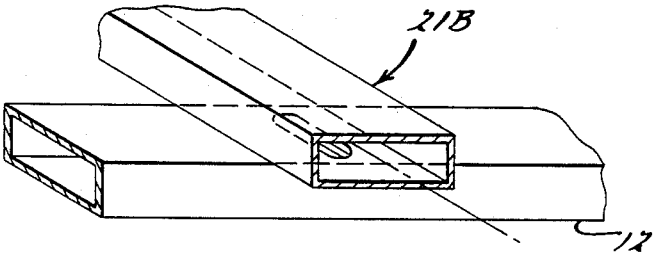

While a short circuited waveguide stub termination for slot 20 has been illustrated to describe the principles of the invention in an H-plane arrangement, other alternative terminations may be employed to achieve the same result. For example, a short circuited section of parallel waveguide one-half wavelength long (or odd multiples thereof), may be placed parallel to the principle waveguide section with an aperture communicating with the termination slot. See FIG. 7. Alternatively, the termination slot may lie at right angles to waveguide 12 so that slot 20 lies on the center line of the termination waveguide and thus does not couple to the waveguide mode - slot 20 truly sees an open circuit. See FIG. 8.

Using either the series array of FIG. 2 or the shunt array of FIG. 3, or combinations of both, such as the antenna array 10 of FIG. 1, it is possible to produce different amplitude distributions of slot voltage in sum and difference modes. The sum radiation pattern is unchanged by the termination, while the difference pattern can be made to have lower side lobes than are conventionally achieved because of the elimination of the center slot voltage for difference mode excitation.

While the invention has been illustrated in terms of a presently preferred embodiment of flat-plate antenna array, and in terms of separate shunt slot and series slot radiators, it will be understood that the invention is capable of use in many different applications and many different antenna designs. Hence, the invention is susceptible to certain modification without departing from the spirit of the invention as set forth in the appended claims.

What is claimed is:

1. A slot array antenna having an improved difference radiation pattern comprising:

a waveguide section having at least one pair of opposing broadwalls and having first and second ends for exciting with electromagnetic energy;

said waveguide having an odd number of slot radiators including a center slot radiator at spaced intervals in one of said broadwalls;

at least one termination means disposed behind said center slot radiator in the opposing broadwall opposite said one broadwall and centered about said center slot radiator;

said termination means being inoperative when the ends of said waveguide are fed in a sum mode thereby permitting said center slot radiator to radiate energy, and being operative when the ends of said waveguide are fed in a difference mode thereby preventing said center slot radiator from radiation energy.

2. The antenna of claim 1 wherein said slot radiators are shunt slot radiators.

3. The antenna of claim 1 wherein said slot radiators are series slot radiators.

4. The antenna of claim 1 wherein said termination means comprises an open circuit termination.

5. The antenna of claim 1 wherein said slot radiators are shunt radiators and said termination means comprises a series slot behind said center slot radiator in the opposing broadwall opposite said one broadwall and a short circuit stub coupled with said series slot.

6. The antenna of claim 5 wherein said stub is an odd multiple of a quarter wavelength long.

7. The antenna of claim 1 wherein said slot radiators are shunt radiators and said termination means comprises a series slot behind said center slot radiator in the opposing broadwall opposite said one broadwall and a short circuit parallel waveguide section coupled with said series slot.

8. The antenna of claim 7 wherein said parallel waveguide section is an even multiple of a quarter wavelength long.

9. The antenna of claim 1 wherein said slot radiators are series radiators and said termination means comprises a pair of apertures equidistant from and behind said center slot radiator in the opposing broadwall opposite said one broadwall and an auxiliary waveguiding means coupled with said apertures for providing an auxiliary wave path.

10. The antenna of claim 9 wherein said waveguiding means provides a wave path having a path length of a multiple of one wavelength.

11. The antenna of claim 9 wherein said apertures are spaced one-half wavelength apart.

12. A slot array antenna comprising:

a plurality of waveguide sections disposed parallel to one another each section having first and second opposing broadwalls;

said waveguide sections each having a plurality of slot radiators including a center slot radiator at spaced intervals in said first broadwall;

said waveguide sections each having at least one first termination means disposed behind said center slot radiator in said second broadwall;

a plurality of spaced apart feed waveguides disposed parallel to one another and perpendicular to said waveguide sections and contacting said second broadwalls each feed waveguide having first and second ends for exciting with electromagnetic energy;

said feed waveguides each having third and fourth opposing broadwalls and having a plurality of feed slots including a center feed slot at spaced intervals in said third broadwall, one of said feed slots communicating with each of said waveguide sections;

said feed waveguides each having at least one second termination means disposed behind said center feed slot in said fourth broadwall;

said first and second terminations being centered on said waveguides so that sum mode excitation of said ends of said feed waveguides produces a substantially inoperative termination, thereby permitting the excitation of said center slot radiators and said center feed slots;

and whereby difference mode excitation of said ends of said feed waveguides produces an operative termination, thereby substantially preventing the excitation of said center slot radiators and said center feed slots.

13. The antenna of claim 12 wherein said slot radiators are shunt radiators.

14. The antenna of claim 12 wherein said feed slots are series slots.

15. The antenna of claim 12 wherein both termination means are an open circuit terminations for difference mode excitation.

16. The antenna of claim 12 wherein said second termination means provides an auxiliary wave path around said center feed slot.

* * * * *